US005170692A

United States Patent [19]

Lonnemo

[11] Patent Number: 5,170,692

[45] Date of Patent: Dec. 15, 1992

[54] HYDRAULIC CONTROL SYSTEM

[75] Inventor: Kurt R. Lonnemo, Searcy, Ark.

[73] Assignee: Vickers, Incorporated, Troy, Mich.

[21] Appl. No.: 787,260

[22] Filed: Nov. 4, 1991

[51] Int. Cl.[5] ..... F15B 11/08

[52] U.S. Cl. ..... 91/461; 91/459; 60/459; 60/468

[58] Field of Search ..... 91/461, 459, 364; 60/459, 460, 464, 468

[56] References Cited

U.S. PATENT DOCUMENTS

| | | | |
|---|---|---|---|
| 3,972,267 | 8/1976 | Haak et al. | 91/461 X |
| 4,407,122 | 10/1983 | Nanda | 60/452 X |
| 4,466,336 | 8/1984 | Broome et al. | 60/460 X |
| 4,616,476 | 10/1986 | Oneyama et al. | 91/461 X |
| 4,811,649 | 3/1989 | Heusser | 91/459 X |
| 4,964,611 | 10/1990 | Anderson | 251/30.02 |
| 5,048,295 | 9/1991 | Hoscheler | 60/464 X |

*Primary Examiner*—Edward K. Look

*Assistant Examiner*—Hoang Nguyen

*Attorney, Agent, or Firm*—Barnes, Kisselle, Raisch, Choate, Whittemore & Hulbert

[57] ABSTRACT

A hydraulic control system for controlling a hydraulic actuator comprising a pump for supplying fluid to the actuator and a directional valve for controlling the flow of fluid to the actuator. The directional valve includes a poppet piston that provides a variable orifice. The position of the poppet piston is controlled by a pilot flow controlled by a pilot valve which may be controlled by a solenoid controller. The flow out of the pilot valve is connected to the outlet of the directional valve. A pressure compensator is provided between the inlet to the directional valve and the pilot valve and maintains the pilot flow to the pilot valve constant. The pressure of fluid being applied to the actuator by the directional valve is also sensed and caused to produce a force opposing the opening force applied to the pilot valve to result in a smooth and accurate control of the load.

14 Claims, 5 Drawing Sheets

FIG. 2
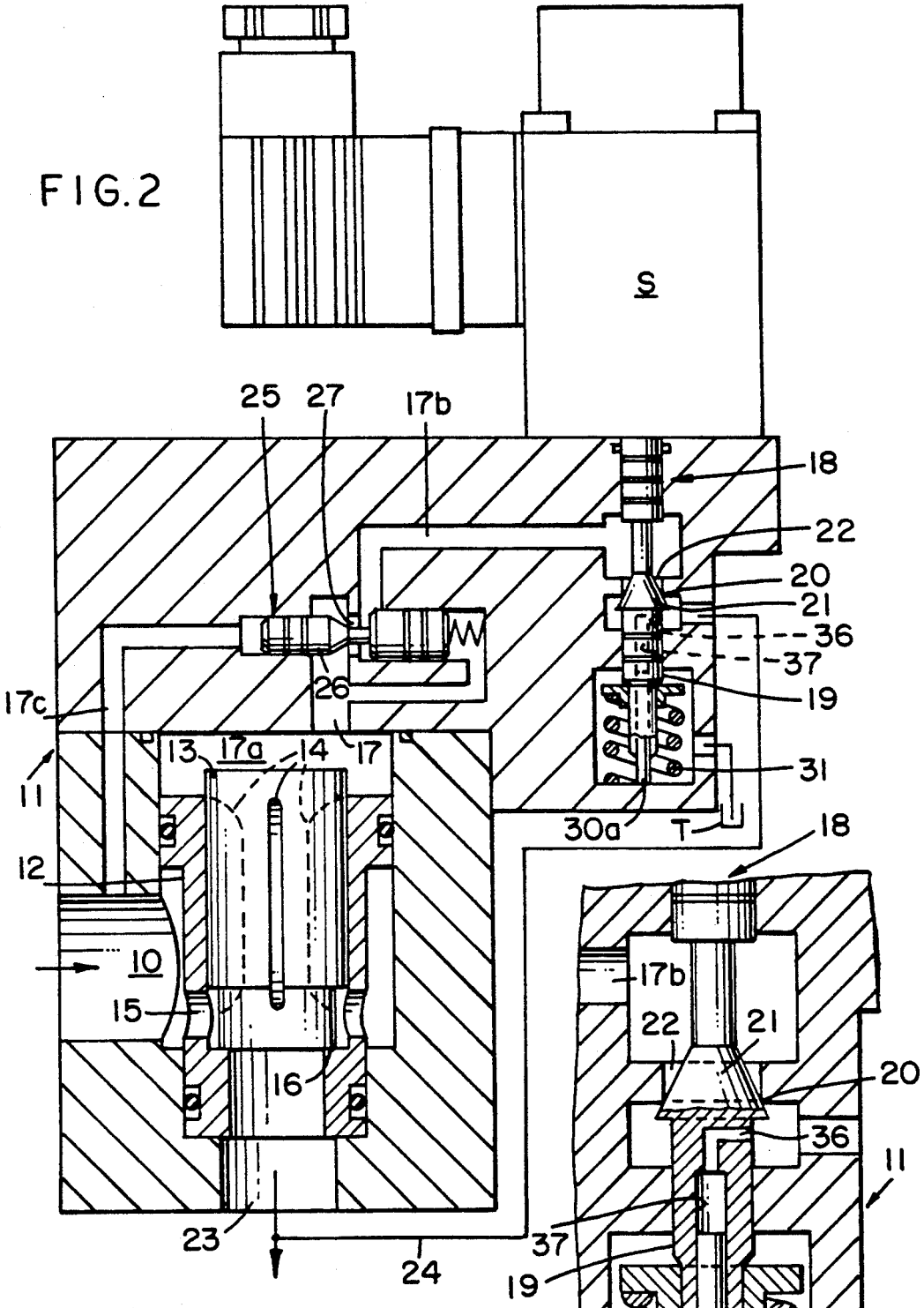
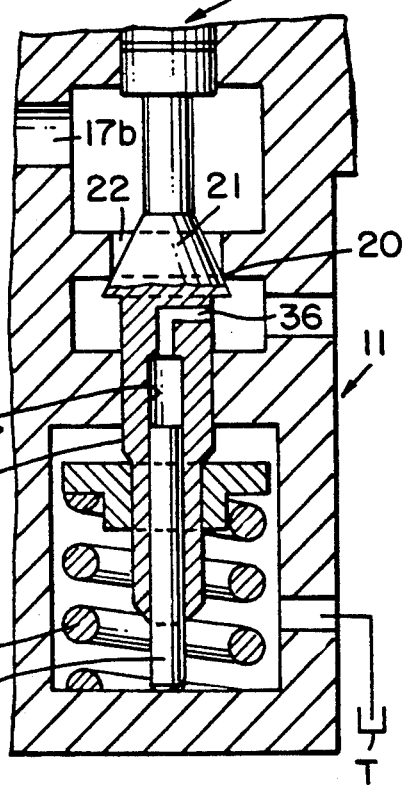
FIG. 2A

CLOSED CENTER LOAD SENSING

HYDRAULIC CONTROL SYSTEM

This invention relates to hydraulic control systems and particularly to hydraulic control systems for controlling the movement of linear or rotary actuators

BACKGROUND AND SUMMARY OF THE INVENTION

This invention relates to hydraulic systems for controlling a plurality of actuators such as hydraulic cylinders which are found, for example, in earth moving equipment such as excavators and cranes. In such a system, it is conventional to provide a pilot operated control valve for each actuator which is controlled by a manually or fluid or electric operated controller through a pilot hydraulic circuit. The control valve functions to supply hydraulic fluid to the actuator to control the speed and direction of operation of the actuator.

In U.S. Pat. Nos. 4,201,052 and 4,480,527, having a common assignee with the present application, there is disclosed and claimed a hydraulic system for accurately controlling the position and speed of operation of the actuators; which system is simple and easy to make and maintain; and which system is unaffected by change of load pressure of various portions of the system or other actuators served by the same source. In certain high inertial loads such as swing drives on an excavator which utilize rotary actuators, smooth stopping and starting of the load and accurate positioning of the load are very essential.

In U.S. Pat. No. 4,407,122, there is a disclosed a hydraulic control system comprising a hydraulic actuator, a pilot controller and a pump. The actuator includes a movable element and a pair of openings adapted to function alternately as inlets or outlets for moving the element in opposite directions. The pilot controller supplies fluid to the system at pilot pressure and the pump supplies fluid at pump pressure to the actuator. The control system includes a line adapted for connected to each of the openings and a meter-out valve associated with each of the lines for controlling fluid flow from the actuator. The meter-out valves are each selectively pilot operated by pilot pressure from the pilot controller. A meter-in valve means controls fluid flow from the pump to the actuator and is selectively operable by pilot pressure from the pilot controller. In accordance with U.S. Pat. No. 4,407,122, the supply pressure out of the meter-in valve means is sensed and a pressure is applied to the meter-in valve means opposing the pilot pressure which tends to open the meter-in valve means.

In U.S. Pat. Nos. 4,535,809 and 4,964,611, there is disclosed a directional valve of a different construction wherein the directional valve includes a piston that provides a variable orifice and the position of the piston is controlled by a pilot pressure derived from the flow from the main pump which supplies fluid to the directional valve. Such an arrangement can be utilized for metering the flow to an actuator. However, in certain high inertial loads such as swing drives on an excavator, for example, which utilize rotary actuators, smooth starting and stopping of the load and accurate positioning of the load is essential and the system necessitates further damping which is not obtained by the directional valves shown in U.S. Pat. Nos. 4,535,809 and 4,964,611.

Among the objectives of the present invention are to provide a hydraulic control system utilizing valves of the types shown in U.S. Pat. Nos. 4,535,809 and 4,964,611 which provide damping and resultant smooth and accurate positioning of a load; wherein the system requires minimal modification; and which can be achieved at relatively low additional charge.

In accordance with the preferred form of the invention, a hydraulic control system for controlling a hydraulic actuator comprising a pump for supplying fluid to the actuator and a directional valve for controlling the flow of fluid to the actuator. The directional valve includes a poppet piston that together with the housing provides a variable orifice. The position of the poppet piston is controlled by a pilot flow controlled by a pilot valve which may be controlled by a solenoid controller. The flow out of the pilot valve is directed to a position downstream from the directional valve. A pressure compensator is provided between the inlet to the directional valve and maintains a constant pilot flow each pilot valve position regardless of the pressure, differential of the directional valve. The pressure of fluid being applied to the actuator by the directional valve is also sensed and caused to produce a force opposing the opening force applied to the pilot valve to result in a smooth and accurate control of the load.

DESCRIPTION OF THE DRAWINGS

FIG. 2 is a part sectional schematic view of a modified form of hydraulic control system.

FIG. 2A is a fragmentary view of an enlarged scale of a portion of FIG. 2.

DESCRIPTION

Figure 1:
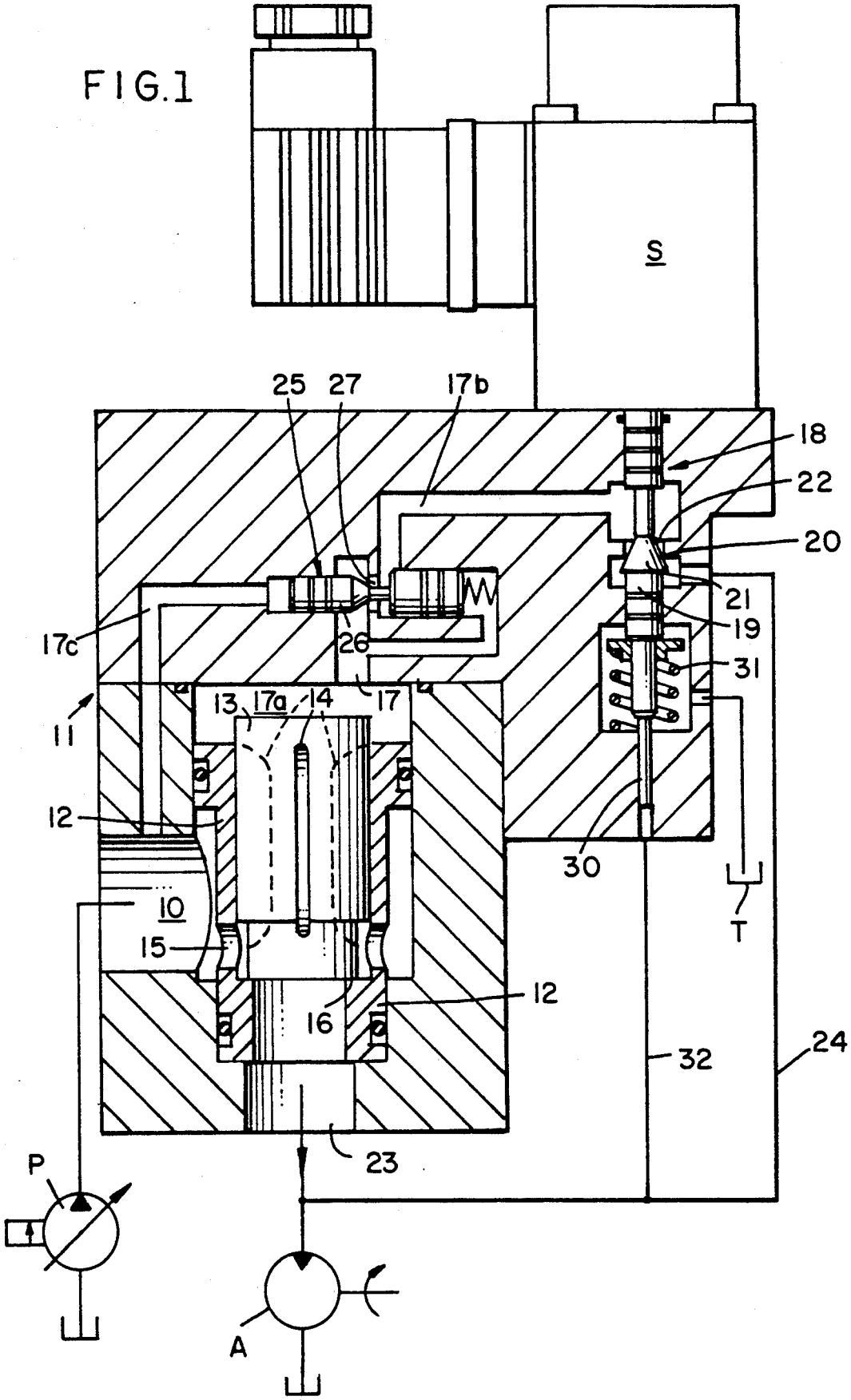
FIG. 1 is a part sectional schematic view of a hydraulic control system embodying the invention.

Referring to FIG. 1, a hydraulic control system embodying the invention comprises a pump P that is adapted to supply fluid to an inlet of an actuator A. The pump P directs fluid to the inlet 10 of a directional valve 11 that includes a sleeve 12 surrounding a poppet piston 13 that has a plurality of axial slots 14 therein. The sleeve 12 includes passages 15 that supply the fluid from the pump to the grooves 14 so that as the piston 13 moves a variable orifice is provided. The poppet piston 13 is movable to a maximum closed position defined by a seat 16. The poppet piston 13 is movable to a maximum open position defined by the upper valve body. Poppet piston 13 includes an upper portion having a larger diameter than the lower portion. The valve 11 is of the type shown in the aforementioned U.S. Pat. Nos. 4,535,809 and 4,964,611, incorporated herein by reference.

A portion of the fluid at the inlet 10 is provided by slots 14 to a pilot valve 18 through a passage 17 from the space **17*a* above the poppet valve 13 and through a line 17*b* to the pilot valve 18 that includes a pilot spool 19 controlling the flow past an orifice 20 by a conical portion 21 engaging a seat 22. The position of the pilot spool 19 is controlled by a pilot controller herein shown as a variable position solenoid S. When the solenoid S is energized, an electrical signal provides a magnetic field that determines the force on the spool 19 urging the pilot spool to open orifice 20. By this arrangement, the spool 19 is placed under a yielding force which can be opposed, as presently described. Alternatively, a manual controller could be used, but it would be required that a spring be positioned between the manual controller and the end of the spool 19. Fluid moving past the orifice 20 communicates with a outlet 23 through a line 24**.

In a preferred form, the system further includes a pressure compensator valve 25 in a line 17*c* from which senses the pressure above the poppet piston 13 and the valve inlet 10 maintains the pilot flow to the pilot valve constant regardless of the pressure drop over the valve 11. Pressure compensator valve 25 includes a spring loaded piston 26 and an orifice 27.

In accordance with the invention, a feedback piston 30 is provided in the spring chamber 31 of the pilot valve 18 and the end of the piston 30 communicates through a line 32 to line 24. In this manner, the feedback piston 30 senses the outlet pressure from the directional valve 11 through line 32 and applies a force opposing the force of the solenoid S and thereby provide for a smooth and accurate control of the movement of the actuator A.

In the form of the invention shown in FIG. 2, the feedback spool or pin 30*a* senses the pressure in the line 24 through openings 26 and 27 in the pilot spool 19 to thereby provide an opposing force to the force from the solenoid S on the pilot spool 19.

Figure 3:
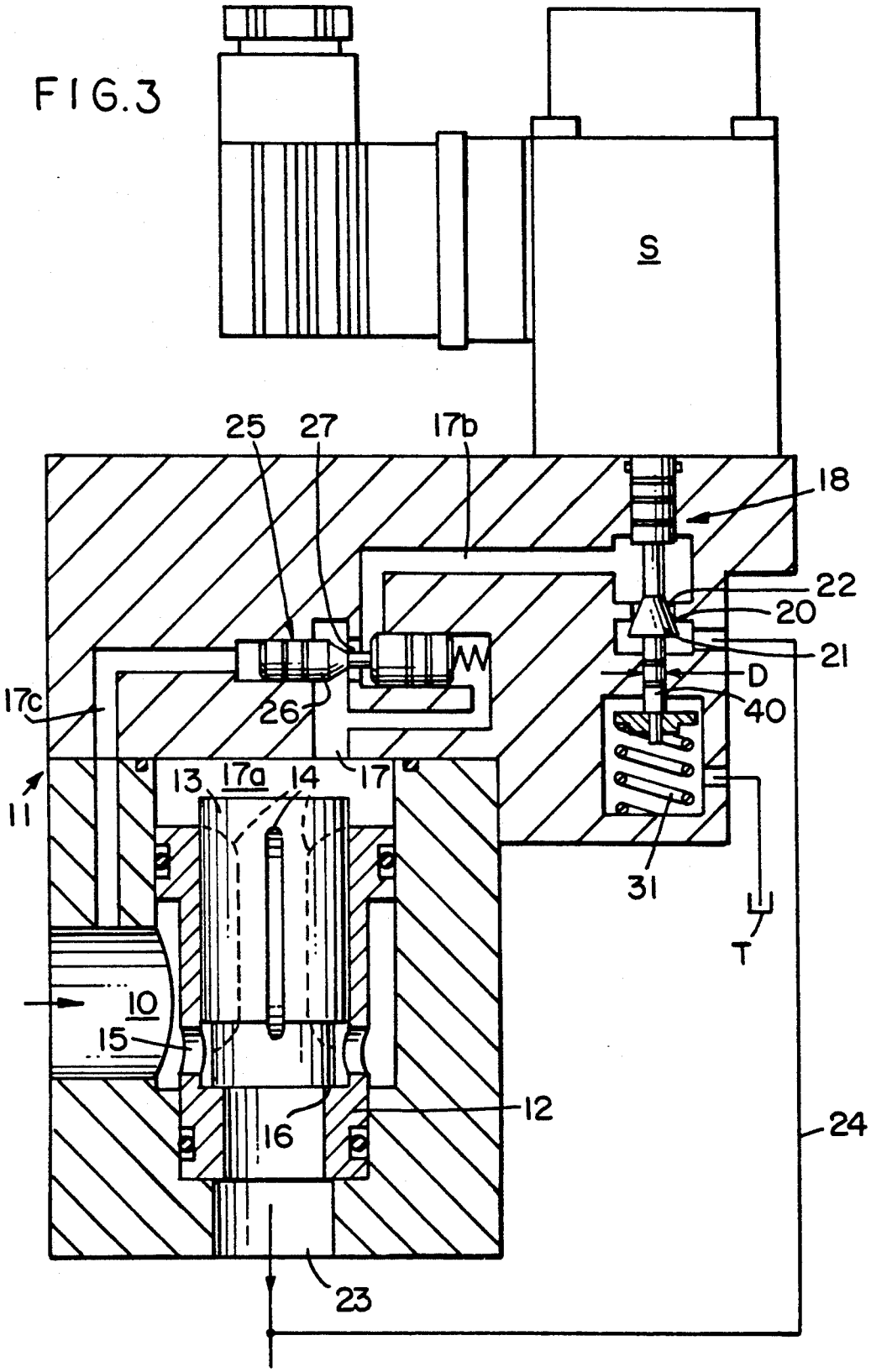
FIG. 3 is a sectional schematic of a further modified form of hydraulic control system.

In the form of the invention shown in FIG. 3, the feedback is achieved by having a reduced portion 40 of the spool 18 such that a force is provided opposing the movement of the pilot spool. The manner in which the variation in diameter affects the amount of dampening is shown by reference to FIG. 6. The several curves showing the amount of dampening is varied by the diameter and, in turn, the amount of force that is opposing movement of the pilot valve.

Figure 4:
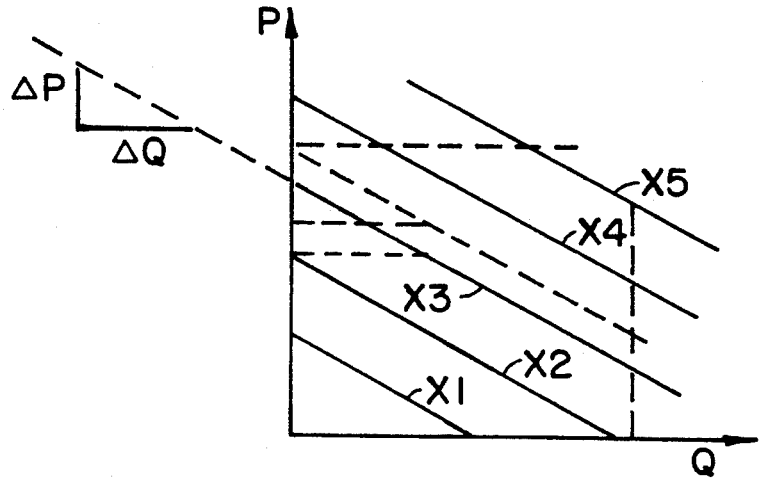
FIG. 4 is a diagram of curves of pressure versus flow for hydraulic control system embodying the invention.
Figure 5:
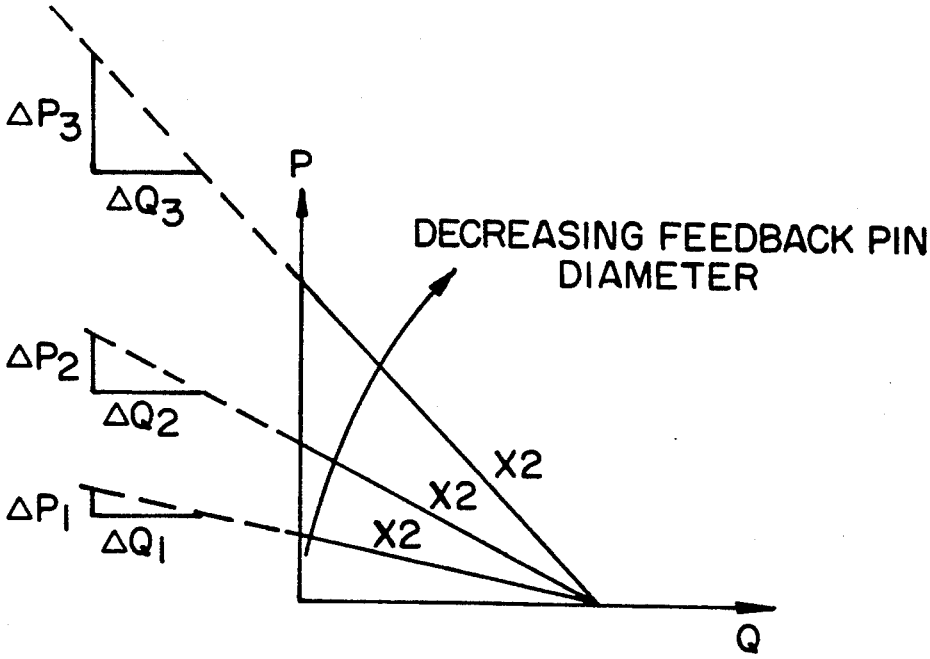
FIG. 5 is a diagram of curves of pressure versus flow for a hydraulic system as shown in FIG. 1.

The overall control of the pressure versus flow and resultant dampening is shown in FIG. 4. System dampening is proportional to $\Delta Q/\Delta P$.

Figure 6:
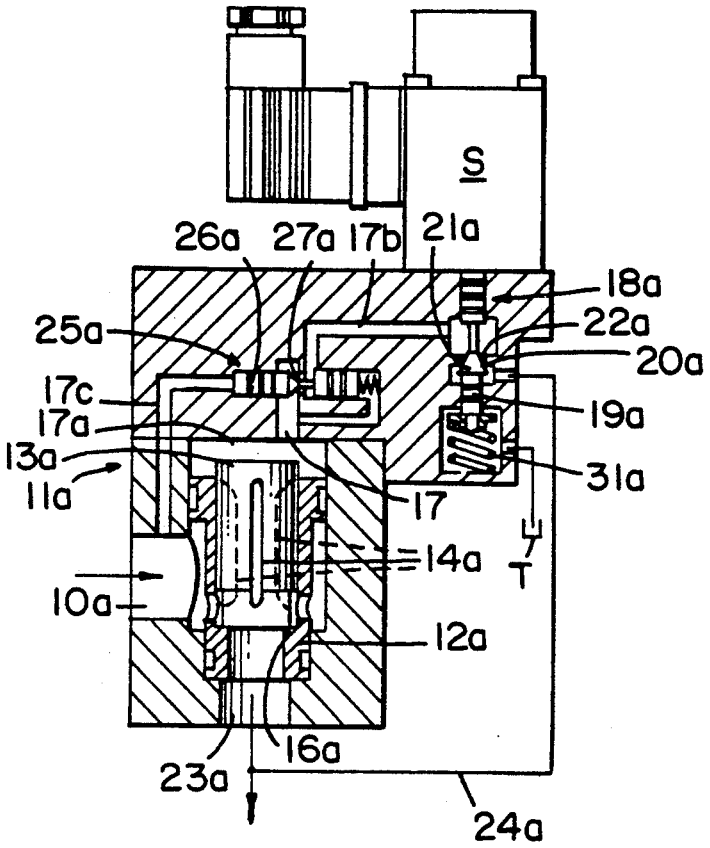
FIG.6 PRIOR ART
FIG. 6 is a part sectional view of a prior art hydraulic control system.

FIG. 6 shows the prior art construction wherein there is no feedback control wherein corresponding parts have the suffix "a".

Figure 7:
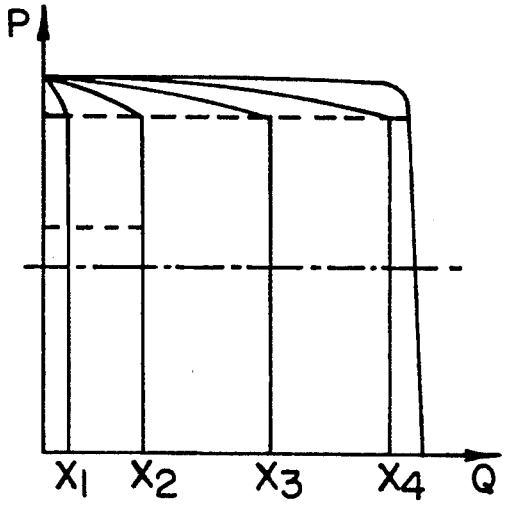
FIG. 7 is a diagram of curves of pressure versus flow for a hydraulic control system shown in FIG. 6.

It can be seen that such a hydraulic control system does not have any means for sensing the pressure of fluid being applied to the actuator and producing a force opposing the opening force on the pilot valve. Such a construction results in the curve shown in FIG. 7. It can be seen that for various amounts of flow there is no damping and, as a result, there will not be smooth and accurate operation under conditions such as occur, for example, under high inertial loads such as swing drives on an excavator.

I claim:

1. A hydraulic control system for controlling a hydraulic actuator comprising a pump for supplying fluid to the actuator, a housing, a directional valve in said housing for controlling the flow of fluid to the actuator, a pilot valve having a pilot spool, a pilot controller for applying a yielding force on the pilot spool for controlling the opening of the pilot valve, the directional valve including a poppet piston with slots which cooperates with said housing to provide a variable orifice, a first line for directing a portion of the fluid from the orifice of the directional valve to the pilot valve, and a second line for directing the flow out of the pilot valve to a position downstream from the directional valve, the position of the poppet piston being controlled by flow in said second line which, in turn, is controlled by said pilot valve, and means for sensing the pressure of fluid being applied to the actuator producing a force opposing the opening force on the pilot valve to result in a smooth and accurate control of the load.

2. The hydraulic control system set forth in claim 1 wherein said means for sensing and producing a force opposing movement of the pilot spool comprises a spring chamber in said pilot valve, a line extending from a position downstream of the spring chamber to the outlet of the directional valve, and a feedback piston positioned in said line sensing the pressure at the outlet of the directional valve and applying a force opposing the opening force on the pilot spool.

3. The hydraulic control system set forth in claim 1 wherein said means for sensing the pressure supplied to the actuator and causing a force opposing the movement of the spool of the pilot valve comprises a spring chamber in said pilot valve, a feedback piston positioned in the spring chamber of the pilot valve, said pilot valve having openings therein defining a chamber between the pilot spool and the feedback piston such that the pressure of fluid supplied to the actuator communicates with said chamber applying a force to the spool of the pilot valve.

4. The hydraulic control system set forth in claim 1 wherein said means for sensing the pressure of fluid being supplied to the actuator by the directional valve and producing a force opposing the movement of the pilot spool comprises a portion on said pilot spool downstream from the pilot valve orifice that is being controlled having a lesser diameter than the portion of the pilot spool to which pressure is being supplied such that an unbalance is provided to produce a force opposing the opening movement of the pilot spool.

5. The hydraulic control system set forth in claim 2 wherein the diameter of said feedback piston is selected such that the desired system damping is achieved, the greater the diameter the greater the damping.

6. The hydraulic control system set forth in claim 3 wherein the diameter of said feedback piston is selected such that the desired system damping is achieved, the greater the diameter the greater the damping.

7. The hydraulic control system set forth in any one of claims 1–4, 5–6 including a pressure compensator valve in said first line for sensing the pressure above the poppet piston and the valve inlet and maintaining the pilot flow to the pilot valve constant regardless of the pressure drop over the directional valve.

8. For use in a hydraulic system for controlling a hydraulic actuator including a pump for supplying fluid to the actuator, a hydraulic control system comprising a housing, a directional valve in said housing for controlling the flow of fluid to the actuator, a pilot valve having a pilot spool, a pilot controller for applying a yielding force on the pilot spool for controlling the opening of the pilot valve, the directional valve including a poppet piston with slots which cooperates with said housing to provide a variable orifice, a first line for directing a portion of the fluid into the directional valve to the pilot valve, and a second line for directing the flow out of the pilot valve to a position downstream from the directional valve, the position of the poppet piston being controlled by flow in said second line which, in turn, is controlled by said pilot valve, means for sensing the pressure of fluid being applied to the actuator producing a force opposing the opening force on the pilot valve to result in a smooth and accurate control of the load.

9. The hydraulic control system set forth in claim 8 wherein said means for sensing and producing a force opposing movement of the pilot spool comprises a spring chamber in said pilot valve, a line extending from a position downstream of the spring chamber to the outlet of the directional valve, and a feedback piston positioned in said line sensing the pressure at the outlet of the directional valve and applying a force opposing the opening force on the pilot spool.

10. The hydraulic control system set forth in claim 8 wherein said means for sensing the pressure supplied to the actuator and causing a force opposing the movement of the spool of the pilot valve comprises a feedback piston positioned in the spring chamber of the pilot valve, said pilot valve having openings therein defining a chamber between the pilot spool and the feedback piston such that the pressure of fluid supplied to the actuator communicates with said chamber applying a force to the spool of the pilot valve.

11. The hydraulic control system set forth in claim 8 wherein said means for sensing the pressure of fluid being supplied to the actuator by the directional valve and producing a force opposing the movement of the pilot spool comprises a portion on said pilot spool downstream from the orifice that is being controlled having a lesser diameter than the portion of the pilot spool to which pressure is being supplied such that an unbalance is provided to produce a force opposing the opening movement of the pilot spool.

12. The hydraulic control system set forth in claim 9 wherein the diameter of said feedback piston is selected such that the desired system damping is achieved, the greater the diameter the greater the damping.

13. The hydraulic control system set forth in claim 10 wherein the diameter of said feedback piston is selected such that the desired system damping is achieved, the greater the diameter the greater the damping.

14. The hydraulic control system set forth in any one of claims 8–11, 12 and 13 including a pressure compensator valve in said first line for sensing the pressure of the poppet piston and maintaining the pilot flow to the pilot valve constant.

* * * * *